US005703034A

United States Patent [19]

Offshack et al.

[11] Patent Number: 5,703,034

[45] Date of Patent: Dec. 30, 1997

[54] BLEACH CATALYST PARTICLES

[75] Inventors: Edward Robert Offshack, Cincinnati; Jeffrey Donald Painter, Loveland; Melissa Dee Aquino, Cincinnati, all of Ohio

[73] Assignee: The Procter & Gamble Company, Cincinnati, Ohio

[21] Appl. No.: 550,269

[22] Filed: Oct. 30, 1995

[51] Int. Cl.[6] ..... C11D 7/26; C11D 7/50; C11D 7/54

[52] U.S. Cl. ..... 510/376; 510/220; 510/301; 510/302; 510/311; 510/349; 510/441; 510/451; 510/456; 510/505; 510/508

[58] Field of Search ..... 510/220, 301, 510/302, 311, 349, 376, 441, 451, 456, 505, 508, 224

[56] References Cited

U.S. PATENT DOCUMENTS

| | | | |
|---|---|---|---|
| 3,398,096 | 8/1968 | Rotterdam et al. | 252/95 |
| 3,551,338 | 12/1970 | Rapisarda | 252/99 |
| 3,741,903 | 6/1973 | Evans | 252/95 |
| 4,119,557 | 10/1978 | Postlethwaite | 252/99 |
| 4,218,377 | 8/1980 | Stockinger et al. | 260/326.22 |
| 4,325,884 | 4/1982 | Kang | 260/439 |
| 4,364,871 | 12/1982 | Svatak et al. | 260/439 |
| 4,425,278 | 1/1984 | Wirth et al. | 260/429 |
| 4,430,243 | 2/1984 | Bragg | 252/91 |
| 4,450,089 | 5/1984 | Broze et al. | 252/95 |
| 4,478,733 | 10/1984 | Oakes | 252/99 |
| 4,481,129 | 11/1984 | Oakes | 252/186.41 |
| 4,488,980 | 12/1984 | Oakes | 252/99 |
| 4,501,681 | 2/1985 | Groult et al. | 252/174.12 |
| 4,536,183 | 8/1985 | Namnath | 8/107 |
| 4,539,132 | 9/1985 | Oakes | 252/95 |
| 4,568,477 | 2/1986 | Oakes | 252/99 |
| 4,578,206 | 3/1986 | Walker | 252/95 |
| 4,579,678 | 4/1986 | Walker | 252/95 |
| 4,601,845 | 7/1986 | Namnath | 252/99 |
| 4,623,357 | 11/1986 | Urban | 8/107 |
| 4,626,373 | 12/1986 | Finch et al. | 252/96 |
| 4,626,374 | 12/1986 | Finch et al. | 252/174.13 |
| 4,634,551 | 1/1987 | Burns et al. | 252/102 |
| 4,655,782 | 4/1987 | McCallion et al. | 8/111 |
| 4,655,953 | 4/1987 | Oakes | 252/99 |
| 4,711,748 | 12/1987 | Irwin et al. | 264/117 |
| 4,728,455 | 3/1988 | Rerek | 252/99 |
| 4,786,421 | 11/1988 | Butterworth et al. | 252/8.8 |
| 4,810,410 | 3/1989 | Diakun et al. | 252/102 |
| 4,863,626 | 9/1989 | Coyne et al. | 252/91 |
| 4,892,555 | 1/1990 | Leigh et al. | 8/101 |
| 4,915,854 | 4/1990 | Mao et al. | 252/8.8 |
| 4,966,723 | 10/1990 | Hodge et al. | 252/102 |
| 5,002,682 | 3/1991 | Bragg et al. | 252/99 |
| 5,021,187 | 6/1991 | Harriott et al. | 252/186.38 |
| 5,089,162 | 2/1992 | Rapisarda et al. | 252/102 |
| 5,093,021 | 3/1992 | Coyne et al. | 252/91 |
| 5,114,606 | 5/1992 | van Vliet et al. | 252/103 |
| 5,114,611 | 5/1992 | Van Kralingen et al. | 252/186.33 |
| 5,153,161 | 10/1992 | Kerschner et al. | 502/167 |
| 5,167,854 | 12/1992 | Deleeuw et al. | 252/186.27 |
| 5,173,207 | 12/1992 | Drapier et al. | 252/99 |
| 5,194,416 | 3/1993 | Jureller et al. | 502/167 |
| 5,200,236 | 4/1993 | Lang et al. | 427/213 |
| 5,225,102 | 7/1993 | Coyne et al. | 252/186.26 |
| 5,227,084 | 7/1993 | Martens et al. | 252/95 |
| 5,244,594 | 9/1993 | Favre et al. | 252/186.33 |
| 5,246,612 | 9/1993 | Van Dijk et al. | 252/102 |
| 5,246,621 | 9/1993 | Favre et al. | 252/186.33 |
| 5,254,287 | 10/1993 | Deleeuw et al. | 252/186.27 |
| 5,256,779 | 10/1993 | Kerschner et al. | 540/465 |
| 5,274,147 | 12/1993 | Kerschner et al. | 556/45 |
| 5,280,117 | 1/1994 | Kerschner et al. | 540/465 |
| 5,284,944 | 2/1994 | Madison et al. | 540/474 |
| 5,294,365 | 3/1994 | Welch et al. | 252/174.21 |
| 5,449,477 | 9/1995 | Eckhardt | 252/186.1 |

FOREIGN PATENT DOCUMENTS

| | | | |
|---|---|---|---|
| 143491 | 6/1985 | European Pat. Off. | C11D 3/39 |
| 224952 | 6/1987 | European Pat. Off. | C11D 3/39 |
| 272030 | 6/1988 | European Pat. Off. | C11D 3/395 |
| 290223 | 11/1988 | European Pat. Off. | C11D 3/386 |
| 306089 | 3/1989 | European Pat. Off. | C11D 3/395 |
| 384503 | 8/1990 | European Pat. Off. | C11D 3/395 |
| 408131 | 1/1991 | European Pat. Off. | C11D 3/39 |
| 415652 | 3/1991 | European Pat. Off. | C11D 3/39 |
| 458398 | 11/1991 | European Pat. Off. | C11D 3/395 |
| 544440 | 6/1993 | European Pat. Off. | C11D 3/39 |
| 544490 | 6/1993 | European Pat. Off. | C11D 3/39 |
| 549271 | 6/1993 | European Pat. Off. | C11D 3/39 |
| 549272 | 6/1993 | European Pat. Off. | C11D 3/39 |
| 2054019 | 10/1971 | Germany | C11D 7/42 |
| 890186557 | 7/1989 | Japan | C11D 7/54 |
| 3053000 | 3/1991 | Japan | C11D 7/54 |
| 2149418 | 6/1985 | United Kingdom | C11D 3/60 |
| 2267911 | 12/1993 | United Kingdom | C11D 17/00 |
| 94/21777 | 9/1994 | WIPO | C11D 3/39 |
| WO 94/23637 | 10/1994 | WIPO | A47L 15/00 |
| WO 95/17493 | 6/1995 | WIPO | C11D 3/386 |

OTHER PUBLICATIONS

M. L. Tobe, "Base Hydrolysis of Transition–Metal Complexes", Adv. Inorg. Bioinorg. Mech. (1983), 2, pp. 1–94.

G. M. Williams et al., "Coordination Complexes of Cobalt", J. Chem. Ed. (1989), 66 (12), 1043–45.

(List continued on next page.)

*Primary Examiner*—Paul Lieberman
*Assistant Examiner*—Gregory R. Delcotto
*Attorney, Agent, or Firm*—B. M. Bolam; K. W. Zerby; J. J. Yetter

[57] ABSTRACT

The present invention relates to bleach catalyst-containing composite particles suitable for incorporation into granular detergent compositions, said composite particles comprising:

(a) from about 1% to about 60% of bleach catalyst (preferably a cobalt catalyst); and (b) from about 40% to about 99% of carrier material that melts within the range of from about 38° C. to about 77° C. (preferably selected from the group consisting of polyethylene glycols, paraffin waxes, and mixtures thereof), and to processes for making these particles. These particles are particularly useful components of detergent compositions, such as laundry detergent compositions, hard surface cleaners, and especially automatic dishwashing detergent compositions.

7 Claims, No Drawings

OTHER PUBLICATIONS

W. L. Jolly, "The Synthesis and Characterization of Inorganic Compounds", (Prentice–Hall; 1970), pp. 461–463.

L. M. Jackman et al., "Synthesis of Transition–Metal Carboxylato Complexes", Inorg. Chem., 18, pp. 1497–1502 (1979).

T. J. Wierenga et al., "Synthesis of Characterization of Cobalt (III) Nicotinic Acid Complexes", Inorg. Chem., 21 (1982) pp. 2881–2885.

L. M. Jackman et al., "Reaction of Aquapentaamminecobalt(III) Perchlorate with Dicyclohexylcarbodiimide and Acetic Acid", Inorg. Chem., 18 (1979), pp. 2023–2025.

G. Schlessinger, "Carbonatotetramminecobalt(III) Nitrate", Inorg. Synthesis (1960) pp. 173–176.

F. Basolo et al., "Mechanism of Substitution Reactions in Complex Ions", Journal of Physical Chemistry, 56 (1952), pp. 22–25.

F. Basolo et al., "Acidopentamminecobalt(III) Salts", Inorg. Synthesis (1953), pp. 171–177.

Chan et al., "Octahedral Cobalt(m) Complexes and Reactions of the Chloropentakismethylaminecobalt(m) Cation", Anal. J. Chem., 1967, pp. 2529–2531.

U.S. application No. 08/382,742, Scheper et al., filed Feb. 2, 1995.

U.S. application No. 08/382,546, Goldstein et al., filed Feb. 2, 1995.

U.S. application No. 08/382,750, Getty et al., filed Feb. 2, 1995.

U.S. application No. 08/490,699, Perkins, Jun. 16, 1995.

U.S. application No. 08/508,198, Perkins et al., filed Jul, 27, 1995.

U.S. application No. 08/508,193, Scheper et al., Jul. 27, 1995.

U.S. application No. 08/508,197, Perkins et al., Jul. 27, 1995.

U.S. application No. 08/508,196, Haeggberg et al., Jul. 27, 1995.

BLEACH CATALYST PARTICLES

TECHNICAL FIELD

The present invention relates to bleach catalyst-containing particles, and to the preparation of these bleach catalyst-containing particles. These particles are particularly useful components of detergent compositions, such as laundry detergent compositions, hard surface cleaners, and especially automatic dishwashing detergent compositions.

BACKGROUND OF THE INVENTION

Automatic dishwashing, particularly in domestic appliances, is an art very different from fabric laundering. Domestic fabric laundering is normally done in purpose-built machines having a tumbling action. These are very different from spray-action domestic automatic dishwashing appliances. The spray action in the latter tends to cause foam. Foam can easily overflow the low sills of domestic dishwashers and slow down the spray action, which in turn reduces the cleaning action. Thus in the distinct field of domestic machine dishwashing, the use of common foam-producing laundry detergent surfactants is normally restricted. These aspects are but a brief illustration of the unique formulation constraints in the domestic dishwashing field.

Automatic dishwashing with bleaching chemicals is different from fabric bleaching. In automatic dishwashing, use of bleaching chemicals involves promotion of soil removal from dishes, though soil bleaching may also occur. Additionally, soil antiredeposition and anti-spotting effects from bleaching chemicals would be desirable. Some bleaching chemicals, (such as a hydrogen peroxide source, alone or together with tetraacetylethylenediamine, TAED) can, in certain circumstances, be helpful for cleaning dishware, but this technology gives far from satisfactory results in a dishwashing context: for example, ability to remove tough tea stains is limited, especially in hard water, and requires rather large amounts of bleach. Other bleach activators developed for laundry use can even give negative effects, such as creating unsightly deposits, when put into an automatic dishwashing product, especially when they have overly low solubility. Other bleach systems can damage items unique to dishwashing, such as silverware, aluminium cookware or certain plastics.

Consumer glasses, dishware and flatware, especially decorative pieces, as washed in domestic automatic dishwashing appliances, are often susceptible to damage and can be expensive to replace. Typically, consumers dislike having to separate finer pieces and would prefer the convenience and simplicity of being able to combine all their tableware and cooking utensils into a single, automatic washing operation. Yet doing this as a matter of routine has not yet been achieved.

On account of the foregoing technical constraints as well as consumer needs and demands, automatic dishwashing detergent (ADD) compositions are undergoing continual change and improvement. Moreover environmental factors such as the restriction of phosphate, the desirability of providing ever-better cleaning results with less product, providing less thermal energy, and less water to assist the washing process, have all driven the need for improved ADD compositions.

A recognized need in ADD compositions is to have present one or more ingredients which improve the removal of hot beverage stains (e.g., tea, coffee, cocoa, etc.) from consumer articles. Strong alkalis like sodium hydroxide, bleaches such as hypochlorite, builders such as phosphates and the like can help in varying degrees but all can also be damaging to, or leave a film upon, glasses, dishware or silverware. Accordingly, milder ADD compositions have been developed. These make use of a source of hydrogen peroxide, optionally with a bleach activator such as TAED, as noted. Further, enzymes such as commercial amylolytic enzymes (e.g., TERMAMYL® available from Novo Nordisk S/A) can be added. The alpha-amylase component provides at least some benefit in the starchy soil removal properties of the ADD. ADD's containing amylases typically can deliver a somewhat more moderate wash pH in use and can remove starchy soils while avoiding delivering large weight equivalents of sodium hydroxide on a per-gram-of-product basis. It would therefore be highly desirable to secure improved bleach activators specifically designed to be compatible in ADD formulations, especially with enzymes such as amylases. A need likewise exists to secure better amylase action in the presence of bleach activators. Also, enzymes such as commercial protease enzymes (e.g., SAVINASE® available from Novo Nordisk S/A) can be added.

Certain manganese catalyst-containing machine dishwashing compositions are described in U.S. Pat. No. 5,246,612, issued Sep. 21, 1993, to Van Dijk et al. The compositions are said to be chlorine bleach-free machine dishwashing compositions comprising amylase and a manganese catalyst (in the +3 or +4 oxidation state), as defined by the structure given therein. Preferred manganese catalyst therein is a dinuclear manganese, macrocyclic ligand-containing molecule said to be $Mn^{IV}_2(u\text{-}O)_3$(1,4,7-trimethyl-1,4,7-triazacyclononane)$_2(PF_6)_2$.

It has been discovered more recently that cobalt-containing bleach catalysts are particularly effective for use in bleach compositions such as automatic dishwashing compositions.

However, the direct incorporation of the small bleach catalyst particles at the typically very low levels into a particulate detergent composition can present problems. Such granular compositions typically should be made up of particles having mean particle sizes which are all similar to each other, to avoid segregation of components in the composition. Such compositions often comprise particles having mean particles sizes in a defined range of from about 400 to about 2400 microns, more usually from about 500 to about 2000 microns, to achieve good flow and absence of dustiness properties. Any fine or oversize particles outside of these limits must generally be removed by sieving to avoid a particle segregation problem. Addition of fine particle bleach catalysts into conventional granular detergent products thus potentially presents a component separation problem. Fine bleach catalyst particles in a detergent composition matrix may also have chemical stability problems caused by a tendency of the fine particles to interact with other detergent composition components, such as the other bleach system components.

In light of all this, the formulator may very well wish to incorporate small bleach catalyst particles, preferred for stain removal performance, into a detergent matrix containing other components having a generally larger overall mean particle size distribution. In so doing, however, the formulator must avoid the component segregation and chemical stability problems associated with the use of small bleach catalyst particles in this context. The formulator must also maximize the consumer acceptance of the aesthetics of the compositions.

Given the foregoing considerations, it is an object of the present invention to provide bleach catalyst-containing composite particles which are useful for incorporating bleach catalysts into granular detergent products, preferably automatic dishwashing detergent products in a form which maximizes its stain removal performance, chemical stability and consumer acceptable aesthetics, but which minimizes its particle segregation problems. It is a further object of the present invention to incorporate such bleach catalyst-containing composite particles in the form of flakes, micropastilles or extrudates which, while having a size distribution comparable to that of the other components of the granular detergent composition, allow delivery of bleach catalyst particles into the wash solution. Such objectives can be realized by preparing and using bleach catalyst-containing composite particles in accordance with the instant invention.

BACKGROUND ART

U.S. Pat. No. 4,810,410, to Diakun et al, issued Mar. 7, 1989; U.S. Pat. No. 5,246,612, to Van Dijk et at., issued Sep. 21, 1993; U.S. Pat. No. 5,244,594, to Favre et al., issued Sep. 14, 1993; and European Patent Application, Publication No. 408,131, published Jan. 16, 1991 by Unilever NV. See also: U.S. Pat. No. 5,114,611, to Van Kralingen et al, issued May 19, 1992 (transition metal complex of a transition metal, such as cobalt, and a non-macro-cyclic ligand); U.S. Pat. No. 4,430,243, to Bragg, issued Feb. 7, 1984 (laundry bleaching compositions comprising catalytic heavy metal cations, including cobalt); German Patent Specification 2,054,019, published Oct. 7, 1971 by Unilever N.V. (cobalt chelant catalyst); and European Patent Application Publication No. 549,271, published Jun. 30, 1993 by Unilever PLC (macrocyclic organic ligands in cleaning compositions).

SUMMARY OF THE INVENTION

The present invention relates to bleach catalyst-containing composite particles suitable for incorporation into granular detergent compositions, said composite particles comprising:

(a) from about 1% to about 60% of bleach catalyst; and (b) from about 40% to about 99% of carrier material that melts within the range of from about 38° C. to about 77° C., preferably selected from the group consisting of polyethylene glycols, paraffin waxes, and mixtures thereof;

and wherein further said composite particles have a mean particle size of from about 200 to about 2400 microns. Preferred particles have a free water content of less than about 10% by weight. The particles may also optionally contain diluent materials.

The process of the present invention involves the preparation of bleach catalyst-containing composite particles suitable for incorporation into granular detergent compositions as described hereinbefore, especially granular automatic dishwashing detergent products. Such a process comprises the steps of (a) combining the bleach catalyst particles with a molten carrier material which melts within the range of from about 38° C. to 77° C., while agitating the resulting particle-carrier combination to form a substantially uniform admixture of the particles and the carrier material;

(b) cooling the particle-carrier admixture of Step (a) to form a solidified admixture of particles and carrier material; and (c) further working the solidified particle-carrier material admixture formed in Step (b) if or as necessary to form the desired composite particles.

The present invention also relates to the bleach catalyst-containing composite particles as prepared by the process herein and to detergent compositions, especially automatic dishwashing detergent products, which utilize these bleach catalyst-containing composite particles.

The composite particles of this invention comprise both discrete bleach catalyst particles of relatively small particle size and a carrier material, with the composite particles having a mean particle size which is comparable to that of the other conventional component particles used in granular detergent compositions. Such particles thus allow for delivery to a wash solution of small particles of bleach catalyst when the carrier material in the composite particles dissolves away in the aqueous wash solution, thereby releasing the bleach catalyst particles.

While other particle forms are possible, the composite particles of this invention are preferably in the form of flakes or micropastilles. The particles (e.g. flakes and micropastilles) have been found to exhibit enhanced storage stability in the presence of a detergent matrix. Further, the composite particles do not segregate from other particles in the granular detergent compositions into which they are incorporated. Finally, compositions containing such composite particles provide a more consumer acceptable speckled appearance than compositions having individual bleach catalyst particles.

DETAILED DESCRIPTION OF THE INVENTION

The particles according to the present invention comprise discrete particles of bleach catalyst and a carrier material. These particles may optionally contain other components, such as stabilizing additives and/or diluents. Each of these materials, the steps in the composite particle preparation process, the composite particles so prepared and granular (e.g., automatic dishwashing) detergents containing these particles are described in detail as follows:

Bleach Catalyst

The composite particles in accordance with the present invention comprise from about 1% to about 60% by weight, more preferably from about 2% to about 20% by weight, most preferably from about 3% to about 10% by weight of the composite of discrete particles of bleach catalyst. These bleach catalyst particles typically and preferably have a mean particle size of less than about 300 microns, preferably less than about 200 microns, more preferably from about 1 to about 150 microns, most preferably from about 10 to about 100 microns. The bleach catalyst material can comprise the free acid form, the salts, and the like.

One type of bleach catalyst is a catalyst system comprising a transition metal cation of defined bleach catalytic activity, such as copper, iron, titanium, ruthenium tungsten, molybenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of theses catalysts include $Mn^{IV}_2(u\text{-}O)_3$(1,4,7-trimethyl-1,4,7-triazacyclononane)$_2$-$(PF_6)_2$, $Mn^{III}_2(u\text{-}O)_1(u\text{-}OAc)_2$(1,4,7-trimethyl-1,4,7-triazacyclononane)$_2$-($ClO_4$)$_2$, $Mn^{IV}_4$(u-O)$_6$ (1,4,7-triazacyclononane)$_4$-($ClO_4$)$_2$, $Mn^{III}Mn^{IV}_4$(u-O)$_1$(u-OAc)$_2$(1,4,7-trimethyl-1,4,7-triazacyclononane)$_2$-($ClO_4$)$_3$, and mixtures thereof. Others are described in European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, and mixtures thereof.

The bleach catalysts useful in automatic dishwashing compositions and concentrated powder detergent compositions may also be selected as appropriate for the present invention. For examples of suitable bleach catalysts see U.S. Pat. No. 4,246,612 and U.S. Pat. No. 5,227,084.

See also U.S. Pat. No. 5,194,416 which teaches mononuclear manganese (IV) complexes such as Mn(1,4,7-trimethyl-1,4,7-triazacyclononane($OCH_3$)$_3$-($PF_6$).

Still another type of bleach catalyst, as disclosed in U.S. Pat. No. 5,114,606, is a water-soluble complex of manganese (II), (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose, and mixtures thereof.

U.S. Pat. No. 5,114,611 teaches a bleach catalyst comprising a complex of transition metals, including Nm, Co, Fe, or Cu, with an non-(macro)-cyclic ligand. Said ligands are of the formula:

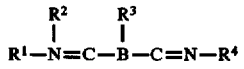

wherein $R^1$, $R^2$, $R^3$, and $R^4$ can each be selected from H, substituted alkyl and aryl groups such that each $R^1$—N=C—$R^2$ and $R^3$—C=N—$R^4$ form a five or six-membered ring. Said ring can further be substituted. B is a bridging group selected from O, S. $CR^5R^6$, $NR^7$ and C=O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe,-bispyridylmethane and -bispyridylamine complexes. Highly preferred catalysts include Co(2,2'-bispyridylamine)$Cl_2$, Di(isothiocyanato) bispyridylamine-cobalt (II), trisdipyridylamine-cobalt(II) perchlorate, Co(2,2-bispyridylamine)$_2O_2ClO_4$, Bis-(2,2'-bispyridylamine) copper(II) perchlorate, tris(di-2-pyridylamine) iron(II) perchlorate, and mixtures thereof.

Other examples include Nm gluconate, Mn($CF_3SO_3$)$_2$, Co($NH_3$)$_5$Cl, and the binuclear Mn complexed with tetra-N-dentate and bi-N-dentate ligands, including $N_4Mn^{III}$(u-O)$_2Mn^{IV}N_4)^+$ and [$Bipy_2Mn^{III}$(u-O)$_2Mn^{IV}bipy_2$]-($ClO_4$)$_3$.

The bleach catalysts may also be prepared by combining a water-soluble ligand with a water-soluble manganese salt in aqueous media and concentrating the resulting mixture by evaporation. Any convenient water-soluble salt of manganese can be used herein. Manganese (II), (III), (IV) and/or (V) is readily available on a commercial scale. In some instances, sufficient manganese may be present in the wash liquor, but, in general, it is preferred to detergent composition Nm cations in the compositions to ensure its presence in catalytically-effective amounts. Thus, the sodium salt of the ligand and a member selected from the group consisting of $MnSO_4$, Mn($ClO_4$)$_2$ or $MnCl_2$ (least preferred) are dissolved in water at molar ratios of ligand:Mn salt in the range of about 1:4 to 4:1 at neutral or slightly alkaline pH. The water may first be de-oxygenated by boiling and cooled by spraying with nitrogen. The resulting solution is evaporated (under $N_2$, if desired) and the resulting solids are used in the bleaching and detergent compositions herein without further purification.

In an alternate mode, the water-soluble manganese source, such as $MnSO_4$, is added to the bleach/cleaning composition or to the aqueous bleaching/cleaning bath which comprises the ligand. Some type of complex is apparently formed in situ, and improved bleach performance is secured. In such an in site process, it is convenient to use a considerable molar excess of the ligand over the manganese, and mole ratios of ligand:Mn typically are 3:1 to 15:1. The additional ligand also serves to scavenge vagrant metal ions such as iron and copper, thereby protecting the bleach from decomposition. One possible such system is described in European patent application, publication no. 549,271.

While the structures of the bleach-catalyzing manganese complexes of the present invention have not been elucidated, it may be speculated that they comprise chelates or other hydrated coordination complexes which result from the interaction of the carboxyl and nitrogen atoms of the ligand with the manganese cation. Likewise, the oxidation state of the manganese cation during the catalytic process is not known with certainty, and may be the (+II), (+III), (+IV) or (+V) valence state. Due to the ligands' possible six points of attachment to the manganese cation, it may be reasonably speculated that multi-nuclear species and/or "cage" structures may exist in the aqueous bleaching media. Whatever the form of the active Mn.ligand species which actually exists, it functions in an apparently catalytic manner to provide improved bleaching performances on stubborn stains such as tea, ketchup, coffee, wine, juice, and the like.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Preferred are cobalt (III) catalysts having the formula:

$$Co[NH_3)_nM'_mB'_bT'_tQ_qP_p]Y_y$$

wherein cobalt is in the +3 oxidation state; n is an interger from 0 to 5 (preferably 4 or 5; most preferably 5); M' represents a monodentate ligand; m is an integer from 0 to 5 (preferably 1 or 2; most preferably 1); B' represents a bidentate ligand; b is an integer from 0 to 2; T' represents a tridentate ligand; t is 0 or 1; Q is a tetradentae ligand; q is 0 or 1; P is a pentadentate ligand; p is 0 or 1; and n+m+2b+3t+4q+5p=6; Y is one or more appropriately selected counteranions present in a number y, where y is an integer from 1 to 3 (preferably 2 to 3; most preferably 2 when Y is a −1 charged anion), to obtain a charge-balanced salt, preferred Y are selected from the group consisting of chloride, nitrate, nitrite, sulfate, titrate, acetate, carbonate, and combinations thereof; and wherein further at least one of the coordination sites attached to the cobalt is labile under automatic dishwashing use conditions and the remaining coordination sites stabilize the cobalt under automatic dishwashing conditions such that the reduction potential for cobalt (III) to cobalt (II) under alkaline conditions is less than about 0.4 volts (preferably less than about 0.2 volts) versus a normal hydrogen electrode.

Preferred cobalt catalysts of this type have the formula:

$$[Co(NH_3)_n(M')_m]Y_y$$

wherein n is an interger from 3 to 5 (preferably 4 or 5; most preferably 5); M' is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and Y is an appropriately selected counteranion present in a number y, which is an integer from 1 to 3 (preferably 2 to 3; most preferably 2 when Y is a −1 charged anion), to obtain a charge-balanced salt.

The preferred cobalt catalyst of this type useful herein are cobalt pentaamine chloride salts having the formula $[Co(NH_3)_5Cl]Y_y$, and especially $[Co(NH_3)_5Cl]Cl_2$.

More preferred are the present invention particles and compositions which utilize cobalt (III) bleach catalysts having the formula:

$$[Co(NH_3)_n(M)_m(B)_b]T_y$$

wherein cobalt is in the +3 oxidation state; n is 4 or 5 (preferably 5); M is one or more ligands coordinated to the cobalt by one site; m is 0, 1 or 2 (preferably 1); B is a ligand coordinated to the cobalt by two sites; b is 0 or 1 (preferably 0), and when b=0, then m+n=6, and when b=1, then m=0 and n=4; and T is one or more appropriately selected counteranions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}$ $s^{-1}$ (25° C.).

Preferred T are selected from the group consisting of chloride, iodide, $I_3^-$, formate, nitrate, nitrite, sulfate, sulfite, citrate, acetate, carbonate, bromide, $PF_6^-$, $BF_4^-$, $B(Ph)_4^-$, phosphate, phosphite, silicate, tosylate, methanesulfonate, and combinations thereof. Optionally, T can be protonated if more than one anionic group exists in T, e.g., $HPO_4^{2-}$, $HCO_3^-$, $H_2PO_4^-$, etc. Further, T may be selected from the group consisting of non-traditional inorganic anions such as anionic surfactants (e.g., linear alkylbenzene sulfonates (LAS), alkyl sulfates (AS), alkylethoxysulfonates (AES), etc.) and/or anionic polymers (e.g., polyacrylates, polymethacrylates, etc.).

The M moieties include, but are not limited to, for example, $F^-$, $SO_4^{-2}$, $NCS^-$, $SCN^-$, $S_2O_3^{-2}$, $NH_3$, $PO_4^{3-}$, and carboxylates (which preferably are mono-carboxylates, but more than one carboxylate may be present in the moiety as long as the binding to the cobalt is by only one carboxylate per moiety, in which case the other carboxylate in the M moiety may be protonated or in its salt form). Optionally, M can be protonated if more than one anionic group exists in M (e.g., $HPO_4^{2-}$, $HCO_3^-$, $H_2PO_4^-$, $HOC(O)CH_2C(O)O$—, etc.) Preferred M moieties are substituted and unsubstituted $C_1$–$C_{30}$ carboxylic acids having the formulas:

RC(O)O— wherein R is preferably selected from the group consisting of hydrogen and $C_1$–$C_{30}$ (preferably $C_1$–$C_{18}$) unsubstituted and substituted alkyl, $C_6$–$C_{30}$ (preferably $C_6$–$C_{18}$) unsubstituted and substituted aryl, and $C_3$–$C_{30}$ (preferably $C_5$–$C_{18}$) unsubstituted and substituted heteroaryl, wherein substituents are selected from the group consisting of —$NR'_3$, —$NR'_4^+$, —C(O)OR', —OR', —C(O)$NR'_2$, wherein R' is selected from the group consisting of hydrogen and $C_1$–$C_6$ moieties. Such substituted R therefore include the moieties —$(CH_2)_nOH$ and —$(CH_2)_nNR'_4^+$, wherein n is an integer from 1 to about 16, preferably from about 2 to about 10, and most preferably from about 2 to about 5.

Most preferred M are carboxylic acids having the formula above wherein R is selected from the group consisting of hydrogen, methyl, ethyl, propyl, straight or branched $C_4$–$C_{12}$ alkyl, and benzyl. Most preferred R is methyl. Preferred carboxylic acid M moieties include formic, benzoic, octanoic, nonanoic, decanoic, dodecanoic, malonic, maleic, succinic, adipic, phthalic, 2-ethylhexanoic, naphthenoic, oleic, palmitic, triflate, tartrate, stearic, butyric, citric, acrylic, aspartic, fumaric, lauric, linoleic, lactic, malic, and especially acetic acid.

The B moieties include carbonate, di- and higher carboxylates (e.g., oxalate, malonate, malic, succinate, maleate), picolinic acid, and alpha and beta amino acids (e.g., glycine, alanine, beta-alanine, phenylalanine).

Cobalt bleach catalysts useful herein are known, being described for example along with their base hydrolysis rates, in M. L. Tobe, "Base Hydrolysis of Transition-Metal Complexes", *Adv. Inorg. Bioinorg. Mech.*, (1983), 2, pages 1–94. For example, Table 1 at page 17, provides the base hydrolysis rates (designated therein as $k_{OH}$) for cobalt pentaamine catalysts complexed with oxalate ($k_{OH}$=2.5×$10^{-4}$ $M^{-1}$ $s^{-1}$ (25° C.)), $NCS^-$($k_{OH}$=5.0×$10^{-4}$ $M^{-1}$ $s^{-1}$ (25° C.)), formate ($k_{OH}$=5.8×$10^{-4}$ $M^{-1}$ $s^{-1}$ (25° C.)), and acetate ($k_{OH}$=9.6×$10^{-4}$ $M^{-1}$ $s^{-1}$ (25° C.)). The most preferred cobalt catalyst useful herein are cobalt pentaamine acetate salts having the formula $[Co(NH_3)_5OAc]T_y$, wherein OAc represents an acetate moiety, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$ (herein "PAC").

These cobalt catalysts are readily prepared by known procedures, such as taught for example in the Tobe article hereinbefore and the references cited therein, in U.S. Pat. No. 4,810,410, to Diakun et al, issued Mar. 7,1989, *J. Chem. Ed.* (1989), 66 (12), 1043–45; The Synthesis and Characterization of Inorganic Compounds, W. L. Jolly (Prentice-Hall; 1970), pp. 461–3; *Inorg. Chem.*, 18, 1497–1502 (1979); *Inorg. Chem.*, 21, 2881–2885 (1982); *Inorg. Chem.*, 18, 2023–2025 (1979); Inorg. Synthesis, 173–176 (1960); and *Journal of Physical Chemistry*, 56, 22–25 (1952); as well as the synthesis examples provided hereinafter.

As a practical matter, and not by way of limitation, the cleaning compositions and cleaning processes herein can be adjusted to provide on the order of at least one part per ten million of the active bleach catalyst species in the aqueous washing medium, and will preferably provide from about 0.1 ppm to about 50 ppm, more preferably from about 1 ppm to about 25 ppm, and most preferably from about 2 ppm to about 10 ppm, of the bleach catalyst species in the wash liquor. In order to obtain such levels in the wash liquor of an automatic dishwashing process, typical automatic dishwashing compositions herein will comprise from about 0.01% to about 1%, more preferably from about 0.01% to about 0.36, of bleach catalyst by weight of the cleaning compositions.

SYNTHESIS OF PENTAAMMINEACETATOCOBALT(III) NITRATE

Ammonium acetate (67.83 g, 0.880 mol) and ammonium hydroxide (256.62, 2.050 mol, 28%) are combined in a 1000 ml three-necked round-bottomed flask fitted with a condenser, mechanical stirrer, and internal thermometer. Cobalt(II) acetate tetrahydrate (110.00 g, 0.400 mol) is added to the clear solution that becomes brown-black once addition of the metal salt is complete. The mixture warms briefly to 40° C. Hydrogen peroxide (27.21 g, 0.400 mol, 50%) is added dropwise over 20 min. The reaction warms to 60°–65° C. and turns red as the peroxide is added to the reaction mixture. After stirring for an additional 20 min, the red mixture is treated with a solution of sodium nitrate (74:86 g, 0.880 mol) dissolved in 50 ml of water. As the mixture stands at room temperature, red crystals form. The solid is collected by filtration and washed with cold water and isopropanol to give 6.38 g (4.9%) of the complex as a red solid. The combined filtrates are concentrated by rotary evaporation (50°–55° C., 15 mm Hg (water aspirator vacuum)) to a slurry. The slurry is filtered and the red solid remaining is washed with cold water and isopropanol to give 89.38 g (68.3%) of the complex. Total yield: 95.76 g (73.1%). Analysis by HPLC, UV-Vis, and combustion are consistent with the proposed structure.

Anal. Calcd for $C_2H_{18}CoN_7O_8$: C, 7.34; H, 5.55; N, 29.97; Co, 18.01. Found: C, 7.31; H, 5.72; N, 30.28; Co, 18.65

Carrier material

The bleach catalyst-containing composite particles comprise from about 40% to about 99% by weight, more preferably from about 50% to about 98% by weight, most preferably from about 60% to about 97% by weight of the composite particle of a carrier material. The carrier material melts in the range from about 38° C. (100° F.) to about 77° C. (170° F.), preferably from about 43° C. (110° F.) to about 71° C. (160° F.), most preferably from about 46° C. (115° F.) to 66° C. (150° F.).

The carrier material should be inert to reaction with the bleach catalyst component of the particle under processing conditions and after solidification. Furthermore, the carrier material is preferably water-soluble. Additionally, the carrier material should preferably be substantially free of moisture present as unbound water.

Polyethylene glycols, particularly those of molecular weight of from about 2000 to about 12000, more particularly from about 3000 to about 10000, and most preferably about 4000 (PEG 4000) to about 8000 (PEG 8000), have been found to be especially suitable water-soluble carrier materials herein. Such polyethylene glycols provide the advantages that, when present in the wash solution, they exhibit soil dispersancy properties and show little or no tendency to deposit as spots or films on the articles in the wash.

Also suitable as carrier materials are paraffin waxes which should melt in the range of from about 38° C. (100° F.) to about 43° C. (110° F.), and $C_{16}$–$C_{20}$ fatty acids and ethoxylated $C_{16}$–$C_{20}$ alcohols. Carriers comprising mixtures of suitable carrier materials are also envisaged.

Particle Water Content

The composite particles should have a low free water content to favor in-product stability and minimize the stickiness of the composite particles. The composite particles should thus preferably have a free water content of less than about 10%, preferably less than about 6%, more preferably less than about 3%, and most preferably less than 1%.

Composite Particle Preparation Process

The composite particles are made by a process comprising the following basic steps:

(i) combining the particles of bleach catalyst with the carrier material as hereinbefore described, while the carrier material is in a molten state and while agitating this combination to form a substantially uniform admixture;

(ii) rapidly cooling the resultant admixture in order to solidify it; and thereafter further working the resulting solidified admixture, if necessary, to form the desired composite particles.

(i) Combining/Mixing Step

The purpose of the combining/mixing step is to ensure dispersion of the discrete bleach catalyst particles in the molten carrier material. In more detail, the combining/mixing step can be carded out using any suitable liquid/solid mixing equipment such as that described in Perry's Chemical Engineer's Handbook under 'Phase Contacting and Liquid/Solid Processing'. For example, the combining and subsequent mixing can be done in batch mode, using a simple agitated batch tank containing the molten carrier. The discrete bleach catalyst particles can be added to the molten carrier and dispersed with an impeller. This is preferable for small batches which can be solidified quickly (for reasons hereinafter set forth).

Alternatively, the combining/mixing can be done continuously. For example, a feeder can be used to meter the bleach catalyst into the flowing molten carrier (e.g., through a powder eductor). The mixture can optionally be further dispersed using any suitable continuous liquid/solid mixing device such as an in-line mixer (such as those described in Chapter 19 of James Y. Oldshue, Fluid Mixing Technology, McGraw Hill Publishing Co., 1983) or a static or motionless mixer (e.g. From Kenics Corporation) in which stationary elements successively divide and recombine portions of the fluid stream. The shear rate can be varied both to optimize dispersion and to determine the eventual bleach catalyst particle size that is obtained. In some applications, further bleach catalyst particle size reduction can be accomplished through use of a colloid mill as the continuous liquid/solid mixing device.

In a preferred embodiment the combining/mixing step acts such as to break up any aggregates which may have formed in the bulk of the bleach catalyst. It is acceptable that the mixing step leads to a slight reduction in the overall mean particle size of the bleach catalyst particles.

(ii) Cooling/Solidification and Particle-Forming Steps

The combining/mixing step is followed by one or more subsequent steps involving cooling and thereby solidifying the mixture resulting from the combining/mixing step. Subsequent steps may also involve forming the composite particles therefrom. These steps encompass executions wherein the solidification and particle-forming aspects occur coincidentally, or alternatively where these steps are carried out sequentially in either order of occurrence.

In executions where solidification of the bulk mixture occurs, the particle is formed from the solidified mixture by use of any suitable comminution procedure, such as grinding procedures.

Cooling and solidification can be carded out using any conventional equipment such as that described in Perry's Chemical Engineer's Handbook under 'Heat Exchangers for Solids'.

In a preferred embodiment, which involves the making of flake-form composite particles, the solidification occurs by introducing the mixture onto a chill roll or cooling belt thus forming a layer of solid material on the roll or belt. This is followed by a step which comprises removing the layer of solid material from the roll or belt and thereafter comminuting of the removed solid material. This can be achieved, for example, by cutting the solid layer into smaller pieces, followed by reducing these pieces to an acceptable size using conventional size reduction equipment (e.g. Quadro Co-mil or a cage mill). The comminuted solidified material can be further worked as necessary by sieving the comminuted material to provide particles of the desired mean particle size and size distribution.

In another preferred embodiment which involves making micropastille-form composite particles, the cooling, solidification and particle-forming aspects occur in an integral process involving the delivery of drops of the bleach catalyst particle/carrier material mixture through a feed orifice onto a cooling belt. The feed orifice is preferably chosen so as to favor formation of micropastilles having a mean particle size of from about 200 to about 2400 microns, more preferably from about 500 to about 2000 microns, and most preferably from about 600 to about 1400 microns. In such a process, further working of the solidified admixture is not necessary to achieve composite particles of the desired size.

In still another preferred embodiment which involves making extruded composite particles, particle formation takes place in an extrusion process in which the bleach catalyst-particle/carrier material mixture is extruded through a die plate into a cooling device (e.g., a cooling drum, fluidized bed cooler, etc.). The die plate orifices are preferably chosen so as to favor formation of extrudates with a diameter between 400–1000 microns, preferably 500–900 microns, more preferably 600–700 microns, and having a mean particle size (by sieving) of from about 200 to about 2,400 microns, more preferably from about 500 to about 2,000 microns, and most preferably from about 600 to about 1,400 microns. The solidified extrudates are then sieved to obtain composite particles of the desired size fraction.

(iii) Optional Additional Steps

A preferred additional step, particularly when flake or extrudate formation is involved, comprises the step of sieving the particles to obtain composite particles having a mean particle size of from about 200 to about 2400 microns, preferably from about 500 to about 2000 microns, most preferably from about 600 to about 1400 microns. Any oversize particles can be subjected to a size reduction step and any undersized particles can be reintroduced into the molten mixture of the combining/mixing step.

Detergent compositions

The composite particles herein are useful components of detergent compositions, particularly those designed for use in automatic dishwashing methods.

The detergent compositions may additionally contain any known detergent components, particularly those selected from pH-adjusting and detergency builder components, other bleaches, bleach activators, silicates, dispersant polymers, low-foaming nonionic surfactants, anionic co-surfactants, enzymes, enzyme stabilizers, suds suppressors, corrosion inhibitors, fillers, hydrotropes and perfumes.

A preferred granular or powdered detergent composition comprises by weight:

(a) from about 0.1% to about 10% of the bleach catalyst-containing composite particles as hereinbefore described;

(b) a bleach component comprising from about 0.01% to about 8% as available oxygen of a peroxygen bleach;

(c) from about 0.1% to about 60% of a pH adjusting component consisting of water-soluble salt or salt/builder mixture selected from sodium carbonate, sodium sesquicarbonate, sodium citrate, citric acid, sodium bicarbonate, sodium hydroxide, and mixtures thereof;

(d) from about 3% to about 10% silicate as $SiO_2$;

(e) from 0 to about 10% of a low-foaming nonionic surfactant other than amine oxide;

(f) from 0 to about 10% of a suds suppressor;

(g) from 0% to about 5% of an active detersive enzyme; and (h) from 0% to about 25% of a dispersant polymer.

Such a composition provides a wash solution pH from about 9.5 to about 11.5.

pH-Adjusting Control/Detergency Builder Components

The detergent compositions herein will preferably provide wash solutions having a pH of at least 7; therefore the compositions can comprise a pH-adjusting detergency builder component selected from water-soluble alkaline inorganic salts and water-soluble organic or inorganic builders. A wash solution pH of from 7 to about 13, preferably from about 8 to about 12, more preferably from about 8 to about 11.0 is desirable. The pH-adjusting component are selected so that when the detergent composition is dissolved in water at a concentration of 2000–6000 ppm, the pH remains in the ranges discussed above. The preferred non phosphate pH-adjusting component embodiments of the invention is selected from the group consisting of (i) sodium/potassium carbonate or sesquicarbonate (ii) sodium/potassium citrate (iii) citric acid (iv) sodium/potassium bicarbonate (v) sodium/potassium borate, preferably borax (vi) sodium/potassium hydroxide;

(vii) sodium/potassium silicate and (viii) mixtures of (i)–(vii).

Illustrative of highly preferred pH-adjusting component systems are binary mixtures of granular sodium titrate dihyrate with anhydrous sodium carbonate, and three-component mixtures of granular sodium citrate dihydrate, sodium carbonate and sodium disilicate.

The amount of the pH adjusting component included in the detergent compositions is generally from about 0.9% to about 99%, preferably from about 5% to about 70%, more preferably from about 20% to about 60% by weight of the composition.

Any pH-adjusting system can be complemented (i.e. for improved sequestration in hard water) by other optional detergency builder salts selected from phosphate or non-phosphate detergency builders known in the art, which include the various water-soluble, alkali metal, ammonium or substituted ammonium borates, hydroxysulfonates, polyacetates, and polycarboxylates. Preferred are the alkali metal, especially sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid, ethylenediamine disuccinic acid (especially the S,S- form); nitrilotriacetic acid, tartrate monosuccinic acid, tartrate disuccinic acid, oxydiacetic acid, oxydisuccinic acid, carboxymethyloxysuccinic acid, mellitic acid, and sodium benzene polycarboxylate salts.

The detergency builders can be any of the detergency builders known in the art, which include the various water-soluble, alkali metal, ammonium or substituted ammonium phosphates, polyphosphates, phosphonates, polyphosphonates, carbonates, borates, polyhydroxysulfonates, polyacetates, carboxylates (e.g. citrates), aluminosilicates and polycarboxylates. Preferred are the alkali metal, especially sodium, salts of the above and mixtures thereof.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137, 3,400,176 and 3,400,148, incorporated herein by reference.

Non-phosphate detergency builders include but are not limited to the various water-soluble, alkali metal, ammonium or substituted ammonium borates, hydroxysulfonates, polyacetates, and polycarboxylates. Preferred are the alkali metal, especially sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid, ethylenediamine disuccinic acid (especially the S,S- form); nitrilotriacetic acid, tartrate monosuccinic acid, tartrate disuccinic acid, oxydisuccinic acid, carboxymethyloxysuccinic acid, mellitic acid, and sodium benzene polycarboxylate salts.

In general, the pH values of the detergent compositions can vary during the course of the wash as a result of the water and soil present. The best procedure for determining whether a given composition has the herein-indicated pH values is as follows: prepare an aqueous solution or dispersion of all the ingredients of the composition by mixing them in finely divided form with the required amount of water to have a 3000 ppm total concentration. Measure the pH using a conventional glass electrode at ambient temperature, within about 2 minutes of forming the solution or dispersion. To be clear, this procedure relates to pH measurement and is not intended to be construed as limiting of the detergent compositions in any way; for example, it is clearly envisaged that fully-formulated embodiments of the instant detergent compositions may comprise a variety of ingredients applied as coatings to other ingredients.

Bleaches

The detergent compositions contain an oxygen bleaching source. Oxygen bleach is employed in an amount sufficient to provide from 0.01% to about 8%, preferably from about 0.1% to about 5.0%, more preferably from about 0.3% to about 4.0%, most preferably from about 0.8% to about 3% of available oxygen (AvO) by weight of the detergent composition.

Available oxygen of a detergent composition or a bleach component is the equivalent bleaching oxygen content thereof expressed as % oxygen. For example, commercially available sodium perborate monohydrate typically has an available oxygen content for bleaching purposes of about 15% (theory predicts a maximum of about 16%). Methods for determining available oxygen of a formula after manufacture share similar chemical principles but depend on whether the oxygen bleach incorporated therein is a simple hydrogen peroxide source such as sodium perborate or percarbonate, is an activated type (e.g., perborate with tetra-acetyl ethylenediamine) or comprises a performed peracid such as monoperphthalic acid. Analysis of peroxygen compounds is well-known in the art: see, for example, the publications of Swern, such as "Organic Peroxides", Vol. I, D. H. Swern, Editor; Wiley, New York, 1970, LC #72-84965, incorporated by reference. See for example the calculation of "percent active oxygen" at page 499. This term is equivalent to the terms "available oxygen" or "percent available oxygen" as used herein.

The peroxygen bleaching systems useful herein are those capable of yielding hydrogen peroxide in an aqueous liquor. These compounds include but are not limited to the alkali metal peroxides, organic peroxide bleaching compounds such as urea peroxide and inorganic persalt bleaching compounds such as the alkali metal perborates, percarbonates, perphosphates, and the like. Mixtures of two or more such bleaching compounds can also be used.

Preferred peroxygen bleaching compounds include sodium perborate, commercially available in the form of mono-, tri-, and tetra-hydrate, sodium pyrophosphate peroxyhydrate, urea peroxyhydrate, sodium percarbonate, and sodium peroxide. Particularly preferred are sodium perborate tetrahydrate, sodium perborate monohydrate and sodium percarbonate. Percarbonate is especially preferred.

Suitable oxygen-type bleaches are further described in U.S. Pat. No. 4,412,934 (Chung et at), issued Nov. 1, 1983, and peroxyacid bleaches described in European Patent Application 033,259. Sagel et al, published Sep. 13, 1989, both incorporated herein by reference, can be used.

Highly preferred percarbonate can be in uncoated or coated form. The average particle size of uncoated percarbonate ranges from about 400 to about 1200 microns, most preferably from about 400 to about 600 microns. If coated percarbonate is used, the preferred coating materials include carbonate, sulfate, silicate, borosilicate, fatty carboxylic acids, and mixtures thereof.

Preferably, the peroxygen bleach component the in composition is formulated with an activator (peracid precursor). The activator is present at levels of from about 0.01% to about 15%, preferably from about 1% to about 10%, more preferably from about 1% to about 8%, by weight of the composition. Preferred activators are selected from the group consisting of tetraacetyl ethylene diamin (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzolyvalerolactam (BZVL), octanoyloxybenzenesulphonate ($C_8$-OBS), perhydrolyzable esters and mixtures thereof, most preferably benzoylcaprolactam and benzolyvalerolactam. Particularly preferred bleach activators in the pH range from about 8 to about 9.5 are those selected having an OBS or VL leaving group.

Preferred bleach activators are those described in U.S. Pat. No. 5,130,045, Mitchell et al, and U.S. Pat. No. 4,412,934, Chung et al, and copending patent applications U.S. Ser. Nos. 08/064,624, 08/064,623, 08/064,621, 08/064,562, 08/064,564, 08/082,270 and copending application to M. Burns, A. D. Willey, R. T. Hartshorn, C. K. Ghosh, entitled "Bleaching Compounds Comprising Peroxyacid Activators Used With Enzymes" and having U.S. Ser. No. 08/133,691 (P&G Case 4890R), all of which are incorporated herein by reference.

The mole ratio of peroxygen bleaching compound (as AvO) to bleach activator in the present invention generally ranges from at least 1:1, preferably from about 20:1 to about 1:1, more preferably from about 10:1 to about 3:1.

Quaternary substituted bleach activators may also be included. The present detergent composition compositions comprise a quaternary substituted bleach activator (QSBA) or a quaternary substituted peracid (QSP); more preferably, the former. Preferred QSBA structures are further described in copending U.S. Ser. No. 08/298,903, 08/298,650, 08/298,906 and 08/298,904 filed Aug. 31, 1994, incorporated herein by reference.

Diacyl Peroxide Bleaching Species

The composite particles in accordance with the present invention may also comprise from about 1% to about 50% by weight, more preferably from about 5% to about 40% by weight, most preferably from about 10% to about 35% by weight of the composite of discrete particles of water-insoluble diacyl peroxide. The individual diacyl peroxide particles in the composite have a mean particle size of less than about 300 microns, preferably less than about 200 microns, more preferably from about 1 to about 150 microns, most preferably from about 10 to about 100 microns.

The diacyl peroxide is preferably a water-insoluble diacyl peroxide of the general formula:

$$RC(O)OO(O)CR^1$$

wherein R and $R^1$ can be the same or different, and each comprises a hydrocarbyl group containing more than ten carbon atoms. Preferably, at least one of these groups has an aromatic nucleus.

Examples of suitable diacyl peroxides are those selected from the group consisting of dibenzoyl peroxide, benzoyl glutaryl peroxide, benzoyl succinyl peroxide, di-(2-methybenzoyl) peroxide, diphthaloyl peroxide and mixtures thereof, more preferably dibenzoyl peroxide, diphthaloyl peroxides and mixtures thereof. The preferred diacyl peroxide is dibenzoyl peroxide.

The diacyl peroxide thermally decomposes under wash conditions (i.e. typically from about 38° C. to about 71° C.) to form free radicals. This occurs even when the diacyl peroxide particles are water-insoluble.

Surprisingly, particle size can play an important role in the performance of the diacyl peroxide, not only in preventing residue deposit problems, but also in enhancing the removal of stains, particularly from stained plasticware. The mean particle size of the diacyl peroxide particles produced in wash solution after dissolution of the particle composite carrier material, as measured by a laser particle size analyzer (e.g. Malvern) on an agitated mixture with water of the diacyl peroxide, is less than about 300 microns, preferably less than about 200 microns. Although water insolubility is an essential characteristic of the diacyl peroxide used in the present invention, the size of the particles containing it is also important for controlling residue formation in the wash and maximizing stain removal performance.

Preferred diacyl peroxides used in the present compositions are also formulated into a carrier material that melts within the range of from about 38° C. to about 77° C., preferably selected from the group consisting of polyethylene glycols, paraffin waxes, and mixtures thereof, as taught in copending U.S. patent application Ser. No. 08/424,132, filed Apr. 17, 1995.

Silicates

The compositions of the type described herein optionally, but preferably comprise alkali metal silicates and/or metasilicates. The alkali metal silicates hereinafter described provide pH adjusting capability (as described above), protection against corrosion of metals and against attack on dishware, inhibition of corrosion to glasswares and chinawares. The $SiO_2$ level is from about 0.5% to about 20%, preferably from about 1% to about 15%, more preferably from about 2% to about 12%, most preferably from about 3% to about 10%, based on the weight of the detergent composition.

The ratio of $SiO_2$ to the alkali metal oxide ($M_2O$, where M=alkali metal) is typically from about 1 to about 3.2, preferably from about 1 to about 3, more preferably from about 1 to about 2.4. Preferably, the alkali metal silicate is hydrous, having from about 15% to about 25% water, more preferably, from about 17% to about 20%.

Anhydrous forms of the alkali metal silicates with a $SiO_2$:$M_2O$ ratio of 2.0 or more are also less preferred because they tend to be significantly less soluble than the hydrous alkali metal silicates having the same ratio.

Sodium and potassium, and especially sodium, silicates are preferred. A particularly preferred alkali metal silicate is a granular hydrous sodium silicate having a $SiO_2$:$Na_2O$ ratio of from 2.0 to 2.4 available from PQ Corporation, named Britesil H2O and Britesil H24. Most preferred is a granular hydrous sodium silicate having a $SiO_2$:$Na_2O$ ratio of 2.0. While typical forms, i.e. powder and granular, of hydrous silicate particles are suitable, preferred silicate particles have a mean particle size between about 300 and about 900 microns with less than 40% smaller than 150 microns and less than 5% larger than 1700 microns. Particularly preferred is a silicate particle with a mean particle size between about 400 and about 700 microns with less than 20% smaller than 150 microns and less than 1% larger than 1700 microns.

Other suitable silicates include the crystalline layered sodium silicates have the general formula:

$$NaMSi_xO_{2x+1}.yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purpose of the present invention, x in the general formula above has a value of 2, 3 or 4. The most preferred material is $\delta$-$Na_2Si_2O_5$, available from Hoechst AG as NaSKS-6.

The crystalline layered sodium silicate material is preferably present in granular detergent compositions as a particle in intimate admixture with a solid, water-soluble ionisable material. The solid, water-soluble ionisable material is selected from organic acids, organic and inorganic acid salts and mixtures thereof.

Dispersant Polymers

When present, a dispersant polymer in the instant detergent compositions is typically present in the range from 0 to about 25%, preferably from about 0.5% to about 20%, more preferably from about 1% to about 7% by weight of the detergent composition. Dispersant polymers are also useful for improved filming performance of the present detergent compositions, especially in higher pH embodiments, such as those in which wash pH exceeds about 9.5. Particularly preferred are polymers which inhibit the deposition of calcium carbonate or magnesium silicate on dishware.

Dispersant polymers suitable for use herein are illustrated by the film-forming polymers described in U.S. Pat. No. 4,379,080 (Murphy), issued Apr. 5, 1983, incorporated herein by reference.

Suitable polymers are preferably at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1000 to about 500,000, more preferably is from about 1000 to about 250,000, and most preferably, especially if the detergent composition is for use in North American automatic dishwashing appliances, is from about 1000 to about 5,000.

Other suitable dispersant polymers include those disclosed in U.S. Pat. No. 3,308,067 issued Mar. 7, 1967, to Diehl, incorporated herein by reference. Unsaturated monomeric acids that can be polymerized to form suitable dispersant polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Copolymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Particularly preferred dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula: —[(C($R^2$)C($R^1$)(C(O)O$R^3$)]— wherein the incomplete valences inside the square braces are hydrogen and at least one of the substituents $R^1$, $R^2$ or $R^3$, preferably $R^1$ or $R^2$, is a 1 to 4 carbon alkyl or hydroxyalkyl group, $R^1$ or $R^2$ can be a hydrogen and $R^3$ can be a hydrogen or alkali metal salt. Most preferred is a substituted acrylic monomer wherein $R^1$ is methyl, $R^2$ is hydrogen and $R^3$ is sodium.

The low molecular weight polyacrylate dispersant polymer preferably has a molecular weight of less than about 15,000, preferably from about 500 to about 10,000, most preferably from about 1,000 to about 5,000. The most preferred polyacrylate copolymer for use herein has a molecular weight of 3500 and is the fully neutralized form of the polymer comprising about 70% by weight acrylic acid and about 30% by weight methacrylic acid.

Other suitable modified polyacrylate copolymers include the low molecular weight copolymers of unsaturated aliphatic carboxylic acids disclosed in U.S. Pat. Nos. 4,530,766, and 5,084,535, both incorporated herein by reference.

Other dispersant polymers useful herein include the polyethylene glycols and polypropylene glycols having a molecular weight of from about 950 to about 30,000 which can be obtained from the Dow Chemical Company of Midland, Mich. Such compounds for example, having a melting point within the range of from about 30° to about 100° C. can be obtained at molecular weights of 1450, 3400, 4500, 6000, 7400, 9500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol. The polyethylene, polypropylene and mixed glycols are referred to using the formula $HO(CH_2CH_2O)_m(CH_2CH(CH_3)O)_n(CH(CH_3)CH_2O)OH$ wherein m, n, and o are integers satisfying the molecular weight and temperature requirements given above.

Yet other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable dispersant polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,929,107, Thompson, issued Nov. 11, 1975; the hydroxyalkyl starch ethers, starch esters, oxidized starches, dextrins and starch hydrolysates described in U.S. Pat No. 3,803,285, Jensen, issued Apr. 9, 1974; the carboxylated starches described in U.S. Pat. No. 3,629,121, Eldib, issued Dec. 21, 1971; and the dextrin starches described in U.S. Pat. No. 4,141,841, McDanald, issued Feb. 27, 1979; all incorporated herein by reference. Preferred cellulose-derived dispersant polymers are the carboxymethyl celluloses.

Yet another group of acceptable dispersants are the organic dispersant polymers, such as polyaspartate.

Low-Foaming Nonionic Surfactant

Detergent compositions of the present invention can comprise low foaming nonionic surfactants (LFNIs). LFNI can be present in amounts from 0 to about 10% by weight, preferably from about 1% to about 8%, more preferably from about 0.25% to about 4%. LFNIs are most typically used in detergent compositions on account of the improved water-sheeting action (especially from glass) which they confer to the detergent composition product. They also encompass non-silicone, nonphosphate polymeric materials further illustrated hereinafter which are known to defoam food soils encountered in automatic dishwashing.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene reverse block polymers. The PO/EO/PO polymer-type surfactants are well-known to have foam suppressing or defoaming action, especially in relation to common food soil ingredients such as egg.

The invention encompasses preferred embodiments wherein LFNI is present, and wherein this component is solid at temperatures below about 100° F., more preferably below about 120° F.

In a preferred embodiment, the LFNI is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms ($C_{16}$–$C_{20}$ alcohol), preferably a $C_{18}$ alcohol condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. No. 4,223,163, issued Sep. 16, 1980, Builloty, incorporated herein by reference.

Highly preferred detergent compositions herein wherein the LFNI is present make use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 80%, preferably from about 30% to about 70%, of the total LFNI.

Suitable block polyoxyethylene-polyoxypropylene polymeric compounds that meet the requirements described herein before include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12-18}$ aliphatic alcohols, do not generally provide satisfactory suds control in the instant detergent compositions. Certain of the block polymer surfactant compounds designated PLURONIC® and TETRONIC® by the BASF-Wyandotte Corp., Wyandotte, Mich., are suitable in detergent composition compositions herein.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene initiated with trimethylolpropane and containing 99 moles of propylene oxide and 24 moles of ethylene oxide per mole of trimethylolpropane.

Suitable for use as LFNI in the detergent composition compositions are those LFNI having relatively low cloud points and high hydrophilic-lipophilic balance (HLB). Cloud points of 1% solutions in water are typically below about 32° C. and preferably lower, e.g., 0° C., for optimum control of sudsing throughout a full range of water temperatures.

LFNIs which may also be used include a $C_{18}$ alcohol polyethoxylate, having a degree of ethoxylation of about 8, commercially available SLF18 from Olin Corp. and any biodegradable LFNI having the melting point properties discussed herein above.

Anionic Co-surfactant

The automatic dishwashing detergent compositions herein can additionally contain an anionic co-surfactant. When present, the anionic co-surfactant is typically in an amount from 0 to about 10%, preferably from about 0.1% to about 8%, more preferably from about 0.5% to about 5%, by weight of the detergent composition composition.

Suitable anionic co-surfactants include branched or linear alkyl sulfates and sulfonates. These may contain from about 8 to about 20 carbon atoms. Other anionic cosurfactants include the alkyl benzene sulfonates containing from about 6 to about 13 carbon atoms in the alkyl group, and mono- and/or dialkyl phenyl oxide mono- and/or di-sulfonates wherein the alkyl groups contain from about 6 to about 16 carbon atoms. All of these anionic co-surfactants are used as stable salts, preferably sodium and/or potassium.

Preferred anionic co-surfactants include sulfobetaines, betaines, alkyl(polyethoxy)sulfates (AES) and alkyl (polyethoxy)carboxylates which are usually high sudsing. Optional anionic co-surfactants are further illustrated in published British Patent Application No. 2,116,199A; U.S. Pat. No. 4,005,027, Hartman; U.S. Pat. No. 4,116,851, Rupe et al; and U.S. Pat. No. 4,116,849, Leikhim, all of which are incorporated herein by reference.

Preferred alkyl(polyethoxy)sulfate surfactants comprise a primary alkyl ethoxy sulfate derived from the condensation product of a $C_6$–$C_{18}$ alcohol with an average of from about 0.5 to about 20, preferably from about 0.5 to about 5, ethylene oxide groups. The $C_6$–$C_{18}$ alcohol itself is preferable commercially available. $C_{12}$–$C_{15}$ alkyl sulfate which has been ethoxylated with from about 1 to about 5 moles of ethylene oxide per molecule is preferred. Where the compositions of the invention are formulated to have a pH of between 6.5 to 9.3, preferably between 8.0 to 9, wherein the pH is defined herein to be the pH of a 1% solution of the composition measured at 20° C., surprisingly robust soil removal, particularly proteolytic soil removal, is obtained when $C_{10}$–$C_{18}$ alkyl ethoxysulfate surfactant, with an average degree of ethoxylation of from 0.5 to 5 is incorporated into the composition in combination with a proteolytic enzyme, such as neutral or alkaline proteases at a level of active enzyme of from 0.005% to 2%. Preferred alkyl (polyethoxy)sulfate surfactants for inclusion in the present invention are the $C_{12}$–$C_{15}$ alkyl ethoxysulfate surfactants with an average degree of ethoxylation of from 1 to 5, preferably 2 to 4, most preferably 3.

Conventional base-catalyzed ethoxylation processes to produce an average degree of ethoxylation of 12 result in a distribution of individual ethoxylates ranging from 1 to 15 ethoxy groups per mole of alcohol, so that the desired average can be obtained in a variety of ways. Blends can be made of material having different degrees of ethoxylation and/or different ethoxylate distributions arising from the specific ethoxylation techniques employed and subsequent processing steps such as distillation.

Alkyl(polyethoxy)carboxylates suitable for use herein include those with the formula $RO(CH_2CH_2O)x\ CH_2C00\text{-}M^+$ wherein R is a $C_6$ to $C_{25}$ alkyl group, x ranges from 0 to 10, preferably chosen from alkali metal, alkaline earth metal, ammonium, mono-, di-, and tri-ethanol-ammonium, most preferably from sodium, potassium, ammonium and mixtures thereof with magnesium ions. The preferred alkyl (polyethoxy)carboxylates are those where R is a $C_{12}$ to $C_{18}$ alkyl group.

Highly preferred anionic cosurfactants herein are sodium or potassium salt-forms for which the corresponding calcium salt form has a low Kraft temperature, e.g., 30° C. or below, or, even better, 20° C. or lower. Examples of such highly preferred anionic cosurfactants are the alkyl (polyethoxy)sulfates.

Detersive Enzymes (including enzyme adjuncts)

Enzymes can be included in the present detergent compositions for a variety of purposes, including removal of protein-based, carbohydrate-based, or triglyceride-based stains from surfaces such as textiles or dishes, for the prevention of refugee dye transfer, for example in laundering, and for fabric restoration. Suitable enzymes include proteases, amylases, lipases, cellulases, peroxidases, and mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases.

"Detersive enzyme", as used herein, means any enzyme having a cleaning, stain removing or otherwise beneficial effect in a laundry, hard surface cleaning or personal care detergent composition. Preferred detersive enzymes are hydrolases such as proteases, amylases and lipases. Preferred enzymes for laundry purposes include, but are not limited to, proteases, cellulases, lipases and peroxidases. Highly preferred for automatic dishwashing are amylases and/or proteases, including both current commercially available types and improved types which, though more and more bleach compatible though successive improvements, have a remaining degree of bleach deactivation susceptibility.

Enzymes are normally incorporated into detergent or detergent additive compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics, dishware and the like. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition. For certain detergents, such as in automatic dishwashing, it may be desirable to increase the active enzyme content of the commercial preparation in order to minimize the total amount of non-catalytically active materials and thereby improve spotting/filming or other end-results. Higher active levels may also be desirable in highly concentrated detergent formulations.

Suitable examples of proteases are the subtilisins which are obtained from particular strains of *B. subtilis* and *B. licheniformis*. One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE® and SAVINASE® from Novo and MAXATASE® from International Bio-Synthetics, Inc., The Netherlands; as well as Protease A as disclosed in EP 130,756 A, Jan. 9, 1985 and Protease B as disclosed in EP 303,761 A, Apr. 28, 1987 and EP 130,756 A, Jan. 9, 1985. See also a high pH protease from Bacillus sp. NCIMB 40338 described in WO 9318140 A to Novo. Enzymatic detergents comprising protease, one or more other enzymes, and a reversible protease inhibitor are described in WO 9203529 A to Novo. Other preferred proteases include those of WO 9510591 A to Procter & Gamble. When desired, a protease having decreased adsorption and increased hydrolysis is available as described in WO 9507791 to Procter & Gamble. A recombinant trypsin-like protease for detergents suitable herein is described in WO 9425583 to Novo.

In more detail, an especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in the patent applications of A. Baeck, et al, entitled "Protease-Containing Cleaning Compositions" having U.S. Ser. No. 08/322,676, and C. Ghosh, et at, "Bleaching Compositions Comprising Protease Enzymes" having U.S. Ser. No. 08/322,677, both filed Oct. 13, 1994.

Amylases suitable herein, especially for, but not limited to automatic dishwashing purposes, include, for example, α-amylases described in GB 1,296,839 to Novo; RAPIDASE®, International Bio-Synthetics, Inc. and TERMAMYL®, Novo. FUNGAMYL® from Novo is especially useful. Engineering of enzymes for improved stability, e.g., oxidative stability, is known. See, for example J. Biological Chem., Vol. 260, No. 11, Jun. 1985, pp 6518–6521. Certain preferred embodiments of the present compositions can make use of amylases having improved stability in detergents such as automatic dishwashing types, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the Baccillus amylases, especialy the Bacillus α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B. licheniformis* alpha-amylase, known as TERMAMYL®, or the homologous position variation of a similar parent amylase, such as *B. amyloliquefaciens, B. subtilis,* or *B. stearothermophilus;* (b) stability-enhanced amylases as described by Genencor International in a paper entitled "Oxidatively Resistant alpha-Amylases" presented at the 2071th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from the assignee, Novo, as DURAMYL®. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Cellulases usable herein include both bacterial and fungal types, preferably having a pH optimum between 5 and 9.5. U.S. Pat. No. 4,435,307, Barbesgoard et al, Mar. 6, 1984, discloses suitable fungal cellulases from *Humicola insolens* or Humicola strain DSM1800 or a cellulase 212-producing fungus belonging to the genus Aeromonas, and cellulase extracted from the hepatopancreas of a marine mollusk, *Dolabella Auricula Solander*. Suitable cellulases are also disclosed in GB-A-2.075.028; GB-A-2.095.275 and DE-OS-2.247.832. CAREZYME® (Novo) is especially useful. See also WO 9117243 to Novo.

Suitable lipase enzymes for detergent usage include those produced by microorganisms of the Pseudomonas group, such as *Pseudomonas stutzeri* ATCC 19.154, as disclosed in GB 1,372,034. See also lipases in Japanese Patent Application 53,20487, laid open Feb. 24, 1978. This lipase is available from Amano Pharmaceutical Co. Ltd., Nagoya, Japan, under the trade name Lipase P "Amano," or "Amano-P." Other suitable commercial lipases include Amano-CES, lipases ex *Chromobacter viscosum*, e.g. *Chromobacter viscosum var. lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. LIPOLASE® enzyme derived from *Humicola lanuginosa* and commercially available from Novo, see also EP 341,947, is a preferred lipase for use herein. Lipase and amylase variants stabilized against peroxidase enzymes are described in WO 9414951 A to Novo. See also WO 9205249 and RD 94359044.

Cutinase enzymes suitable for use herein are described in WO 8809367 A to Genencor.

Peroxidase enzymes may be used in combination with oxygen sources, e.g., percarbonate, perborate, hydrogen peroxide, etc., for "solution bleaching" or prevention of transfer of dyes or pigments removed from substrates during the wash to other substrates present in the wash solution. Known peroxidases include horseradish peroxidase, ligninase, and haloperoxidases such as chloro- or bromo-peroxidase. Peroxidase-containing detergent compositions are disclosed in WO 89099813 A, Oct. 19, 1989 to Novo and WO 8909813 A to Novo.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilised by various techniques. Enzyme stabilisation techniques are disclosed and exemplified in U.S. Pat. No. 3,600,319, Aug. 17, 1971, Gedge et al, EP 199,405 and EP 200,586, Oct. 29, 1986, Venegas. Enzyme stabilisation systems are also described, for example, in U.S. Pat. No. 3,519,570. A useful Bacillus, sp. AC13 giving proteases, xylanases and cellulases, is described in WO 9401532 A to Novo.

Enzyme Stabilizing System

Enzyme-containing, including but not limited to, liquid compositions, herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the detergent composition.

One stabilizing approach is the use of water-soluble sources of calcium and/or magnesium ions in the finished compositions which provide such ions to the enzymes. Calcium ions are generally more effective than magnesium ions and are preferred herein if only one type of cation is being used. Typical detergent compositions, especially liquids, will comprise from about 1 to about 30, preferably from about 2 to about 20, more preferably from about 8 to about 12 millimoles of calcium ion per liter of finished detergent composition, though variation is possible depending on factors including the multiplicity, type and levels of enzymes incorporated. Preferably water-soluble calcium or magnesium salts are employed, including for example calcium chloride, calcium hydroxide, calcium formate, calcium malate, calcium maleate, calcium hydroxide and calcium acetate; more generally, calcium sulfate or magnesium salts corresponding to the exemplified calcium salts may be used. Further increased levels of Calcium and/or Magnesium may of course be useful, for example for promoting the grease-cutting action of certain types of surfactant.

Another stabilizing approach is by use of borate species. See Severson, U.S. Pat. No. 4,537,706. Borate stabilizers, when used, may be at levels of up to 10% or more of the composition though more typically, levels of up to about 3% by weight of boric acid or other borate compounds such as borax or orthoborate are suitable for liquid detergent use. Substituted boric acids such as phenylboronic acid, butaneboronic acid, p-bromophenylboronic acid or the like can be used in place of boric acid and reduced levels of total boron in detergent compositions may be possible though the use of such substituted boron derivatives.

Stabilizing systems of certain cleaning compositions, for example automatic dishashing compositions, may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during dish- or fabric-washing, can be relatively large; accordingly, enzyme stability to chlorine in-use is sometimes problematic. Since perborate or percarbonate, which have the ability to react with chlorine bleach, may present in certain of the instant compositions in amounts accounted for separately from the stabilizing system, the use of additional stabilizers against chlorine, may, most generally, not be essential, though improved results may be obtainable from their use. Suitable chlorine scavenger anions are widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Likewise, special enzyme inhibition systems can be incorporated such that different enzymes have maximum compatibility. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, titrate, formate, lactate, malate, tartrate, salicylate, etc., and mixtures thereof can be used if desired. In general, since the chlorine scavenger function can be performed by ingredients separately listed under better recognized functions, (e.g., hydrogen peroxide sources), there is no absolute requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any enzyme scavenger or stabilizer which is majorly incompatible, as formulated, with other reactive ingredients, if used. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et at.

Silicone and Phosphate Ester Suds Suppressors

The detergent compositions optionally contain an alkyl phosphate ester suds suppressor, a silicone suds suppressor, or combinations thereof. Levels in general are from 0% to about 10%, preferably, from about 0.001% to about 5%. Typical levels tend to be low, e.g., from about 0.01% to about 3% when a silicone suds suppressor is used. Preferred non-phosphate compositions omit the phosphate ester component entirely.

Silicone suds suppressor technology and other defoaming agents useful herein are extensively documented in "Defoaming, Theory and Industrial Applications", Ed., P. R. Garrett, Marcel Dekker, N.Y., 1973, ISBN 0-8247-8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. Highly preferred silicone suds suppressors are the compounded types known for use in laundry detergents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Corning Corp.

Levels of the suds suppressor depend to some extent on the sudsing tendency of the composition, for example, an detergent composition for use at 2000 ppm comprising 2% octadecyldimethylamine oxide may not require the presence of a suds suppressor. Indeed, it is an advantage of the present invention to select cleaning-effective amine oxides which are inherently much lower in foam-forming tendencies than the typical coco amine oxides. In contrast, formulations in which amine oxide is combined with a high-foaming anionic cosurfactant, e.g., alkyl ethoxy sulfate, benefit greatly from the presence of suds suppressors.

Phosphate esters have also been asserted to provide some protection of silver and silver-plated utensil surfaces, however, the instant compositions can have excellent silvercare without a phosphate ester component. Without being limited by theory, it is believed that lower pH formulations, e.g., those having pH of 9.5 and below, plus the presence of the essential amine oxide, both contribute to improved silver care.

If it is desired nonetheless to use a phosphate ester, suitable compounds are disclosed in U.S. Pat. No. 3,314,891, issued Apr. 18, 1967, to Schmolka et al, incorporated herein by reference. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof.

It has been found preferable to avoid the use of simple calcium-precipitating soaps as antifoams in the present compositions as they tend to deposit on the dishware. Indeed, phosphate esters are not entirely free of such problems and the formulator will generally choose to minimize the content of potentially depositing antifoams in the instant compositions.

Corrosion Inhibitor

The detergent compositions may contain a corrosion inhibitor. Such corrosion inhibitors are preferred components of automatic dishwashing compositions in accord with the invention, and are preferably incorporated at a level of from 0.05% to 10%, preferably from 0.1% to 5% by weight of the total composition.

Suitable corrosion inhibitors include paraffin oil typically a predominantly branched aliphatic hydrocarbon having a number of carbon atoms in the range of from 20 to 50: preferred paraffin oil selected from predominantly branched $C_{25-45}$ species with a ratio of cyclic to noncyclic hydrocarbons of about 32:68; a paraffin oil meeting these characteristics is sold by Wintershall, Salzbergen, Germany, under the trade name WINOG 70.

Other suitable corrosion inhibitor compounds include benzotriazole and any derivatives thereof, mercaptans and diols, especially mercaptans with 4 to 20 carbon atoms including lauryl mercaptan, thiophenol, thionapthol, thionalide and thioanthranol. Also suitable are the $C_{12}$–$C_{20}$ fatty acids, or their salts, especially aluminum tristearate. The $C_{12}$–$C_{20}$ hydroxy fatty acids, or their salts, are also suitable. Phosphonated octa-decane and other anti-oxidants such as betahydroxytoluene (BHT) are also suitable.

Other Optional Adjuncts

Depending on whether a greater or lesser degree of compactness is required, filler materials can also be present in the detergent compositions. These include sucrose, sucrose esters, sodium chloride, sodium sulfate, potassium chloride, potassium sulfate, etc., in amounts up to about 70%, preferably from 0% to about 40% of the detergent composition composition. A preferred filler is sodium sulfate, especially in good grades having at most low levels of trace impurities.

Sodium sulfate used herein preferably has a purity sufficient to ensure it is non-reactive with bleach; it may also be treated with low levels of sequestrants, such as phosphonates in magnesium-salt form. Note that preferences, in terms of purity sufficient to avoid decomposing bleach, applies also to builder ingredients.

Hydrotrope materials such as sodium benzene sulfonate, sodium toluene sulfonate, sodium cumene sulfonate, etc., can be present in minor amounts.

Bleach-stable perfumes (stable as to odor); and bleach-stable dyes (such as those disclosed in U.S. Pat. No. 4,714,562, Roselle et al, issued Dec. 22, 1987); can also be added to the present compositions in appropriate amounts. Other common detergent ingredients are not excluded.

Since certain detergent compositions herein can contain water-sensitive ingredients, e.g., in embodiments comprising anhydrous amine oxides or anhydrous citric acid, it is desirable to keep the flee moisture content of the detergent compositions at a minimum, e.g., 7% or less, preferably 4% or less of the detergent composition; and to provide packaging which is substantially impermeable to water and carbon dioxide. Plastic bottles, including refillable or recyclable types, as well as conventional barrier cartons or boxes are generally suitable. When ingredients are not highly compatible, e.g., mixtures of silicates and citric acid, it may further be desirable to coat at least one such ingredient with a low-foaming nonionic surfactant for protection. There are numerous waxy materials which can readily be used to form suitable coated particles of any such otherwise incompatible components.

Method for Cleaning

The detergent compostions herein may be utilized in methods for cleaning soiled tableware. A preferred method comprises contacting the tableware with a pH wash aqueous medium of at least 8. The aqueous medium comprises at least about 0.1 ppm bleach catalyst and available oxygen from a peroxygen bleach. The bleach catalyst is added in the form of the particles described herein.

A preferred method for cleaning soiled tableware comprises using the bleach catalyst-containing particles, enzyme, low foaming surfactant and detergency builder. The aqueous medium is formed by dissolving a solid-form automatic dishwashing detergent in an automatic dishwashing machine. A particularly preferred method also includes low levels of silicate, preferably from about 3% to about 10% $SiO_2$.

EXAMPLES

The following examples are illustrative of the present invention. These examples are not meant to limit or otherwise define the scope of the invention. All parts, percentages and ratios used herein are expressed as percent weight unless otherwise specified.

Example 1

Flakes containing both discrete particles of cobalt catalyst (e.g., Pentaammineacetatocobalt(III) Nitrate, herein "PAC", prepared as described hereinbefore) and PEG 8000 as a carrier are made as follows, in accordance with the present invention:

960 grams of polyethylene glycol of molecular weight 8000 (PEG 8000, sold by BASF as Pluracol E-8000 prills) are placed in a half-gallon plastic tub and heated in a microwave on a high setting for 7 minutes to melt the PEG 8000. The PEG is stirred to ensure uniform consistency and complete melting. The final temperature of the molten PEG 8000 is 61° C. (142° F.).

40 grams of cobalt catalyst [pentaammineacetatocobalt (III) nitrate, prepared as described hereinbefore] are added slowly to the molten PEG 8000. This mixture is stirred with a spatula for 3 minutes to uniformly disperse the powder in the molten PEG.

Immediately, the entire mixture is poured into the nip of a twin drum chill roll. The settings on the chill roll are as follows:

Gap: 0.015 mm

Speed: 50 rpm

Water Temperature: 13° C. (55° F.) (cold water from the tap)

Flakes are formed on the chill roll and scraped off by use of a doctor blade into a pan and collected.

The flakes are then reduced in size by use of a Quadro Co-mil, which is a form of cone mill, with a screen having a 0.039 inch (1 mm) hole openings. The reduced size flakes are then sieved in 200 gram portions using a Tyler 28 mesh, a Tyler 65 mesh, and a pan in a Rotap. The portion which passes through the Tyler 28 mesh but is retained on the Tyler 65 mesh is collected as acceptable flakes. The composition of the resultant flake is:

| | |
|---|---|
| PEG 8000 | 96% |
| Cobalt Catalyst | 4% |

A similar process may be used starting with PEG 4000 in place of the PEG 8000 to obtain PEG 4000/cobalt catalyst particles (96%/4%).

A similar process using 800 grams PEG 8000, 120 grams sodium sulfate, and 80 grams cobalt catalyst produces a flake particle having:

| | |
|---|---|
| PEG 8000 | 80% |
| Cobalt Catalyst | 8% |
| Sodium Sulfate | 12%. |

Example II

Granular automatic dishwashing detergent compositions in accord with the invention are as follows:

TABLE 1

| Ingredients | % by weight A | B | C |
|---|---|---|---|
| Sodium Citrate (as anhydrous) | 29.00 | 15.00 | 15.00 |
| Acusol 480N[1] (as active) | 6.00 | 6.00 | 6.00 |
| Sodium carbonate | — | 17.50 | 20.00 |
| Britesil H2O (as $SiO_2$) | 17.00 | 8.00 | 8.00 |
| 1-hydroxyethylidene-1, 1-diphosphonic acid | 0.50 | 1.00 | 0.50 |
| Nonionic surfactant[2] | — | — | — |
| Nonionic surfactant[3] | 1.50 | 2.00 | 1.50 |
| Savinase 12T | 2.20 | 2.20 | 2.20 |
| Termamyl 60T | 1.50 | — | 0.75 |
| Duramyl | — | 1.50 | — |
| Perborate monohydrate (as AvO) | 0.30 | 2.20 | 2.20 |
| Perborate tetrahydrate (as AvO) | 0.90 | — | — |
| Catalyst particle[4] | 2.00 | 2.00 | 2.00 |
| TAED | — | — | 3.00 |
| Diethylene triamine penta methylene phosphonic acid | 0.13 | — | 0.13 |
| Paraffin | 0.50 | 0.50 | 0.50 |
| Benzotriazole | 0.30 | — | 0.30 |
| Sulfate, water, etc. | | balance | |

[1]Dispersant from Rohm and Haas
[2]Poly Tergent SLF-18 surfactant from Olin Corporation
[3]Plurafac LF404 surfactant from BASF.
[4]The cobalt catalyst of Example I having 96% PEG 8000 and 4% PAC cobalt catalyst.

Example III

Granular automatic dishwashing detergent compositions in accord with the invention are set forth as follows in Table 2:

TABLE 2

| Ingredients | % by weight D | E | F |
|---|---|---|---|
| Sodium Citrate (as anhydrous) | 15.00 | 15.00 | 15.00 |
| Acusol 480N[1] (active) | 6.00 | 6.00 | 6.00 |
| Sodium carbonate | 20.00 | 20.00 | 20.00 |
| Britesil H2O (as $SiO_2$) | 8.00 | 8.00 | 8.00 |
| 1-hydroxyethylidene-1, 1-diphosphonic acid | 1.00 | 1.00 | 1.00 |
| Nonionic surfactant[2] | 2.00 | 2.00 | 2.00 |
| Savinase 6T | 2.00 | 2.00 | 2.00 |
| Termamyl 60T | 1.00 | 1.00 | — |
| Duramyl[4] | — | — | 1.00 |
| Dibenzoyl Peroxide (active) | 0.80 | — | 0.80 |
| Perborate monohydrate (as AvO) | 2.20 | 2.20 | 1.50 |
| Catalyst Particle[3] | 2.00 | 2.00 | 1.00 |
| Sulfate, water, etc. | | balance | |

[1]Dispersant from Rohm and Haas
[2]Polytergent SLF-18 surfactant from Olin Corporation
[3]The cobalt catalyst of Example I having 96% PEG 8000 and 4% PAC cobalt catalyst.
[4]Amylase supplied by Novo Nordisk; may be replaced by OXAmylase supplied by Genencor International.

Example IV

Granular automatic dishwashing detergent compositions in accord with the invention are set forth as follows in Table 3:

TABLE 3

| Ingredients | % by weight G | H | I |
|---|---|---|---|
| Sodium Citrate (as anhydrous) | 10.00 | 15.00 | 20.00 |
| Acusol 480N[1] (active) | 6.00 | 6.00 | 6.00 |
| Sodium carbonate | 15.00 | 10.00 | 5.00 |
| Sodium tripolyphosphate | 10.00 | 10.00 | 10.00 |
| Britesil H2O (as $SiO_2$) | 8.00 | 8.00 | 8.00 |
| 1-hydroxyethylidene-1, 1-diphosphonic acid | 1.00 | 1.00 | 1.00 |
| Nonionic surfactant[2] | 2.00 | 2.00 | 2.00 |
| Savinase 12T | 2.00 | 2.00 | 2.00 |
| Termamyl 60T | 1.00 | 1.00 | 1.00 |
| Dibenzoyl Peroxide (active) | 0.80 | 0.80 | 0.80 |
| Perborate monohydrate (as AvO) | 1.50 | 1.50 | 1.50 |
| Catalyst Particle[3] | 1.00 | 1.00 | 1.00 |
| TAED | — | 2.20 | — |
| Sulfate, water, etc. | | balance | |

[1]Dispersant from Rohm and Haas
[2]Polytergent SLF-18 surfactant from Olin Corporation
[3]The cobalt catalyst of Example I having 96% PEG 8000 and 4% PAC cobalt catalyst.

What is claimed is:

1. A bleach catalyst-containing composite particle suitable for incorporation into granular detergent compositions, said composite particle comprising:

(a) from about 1% to about 60% of a bleach catalyst having the formula $[Co(NH_3)_5OAc]T_y$, wherein OAc represents an acetate moiety and T is one or more appropriately selected counteranions present in a number y, where y is an integer to obtain a charge-balanced salt; and (b) from about 40% to about 99% of polyethylene glycol carrier material that melts within the range of from about 38° C. to about 77° C.;

and wherein further said composite particles have a mean particle size of from about 200 to about 2400 microns and a free water content of less than 6%.

2. The bleach catalyst-containing composite particles according to claim 1 wherein the carrier material is selected from the group consisting of polyethylene glycols having a molecular weight of from about 2000 to about 12000.

3. The bleach catalyst-containing composite particles according to claim 1 wherein the bleach catalyst is selected from the group consisting of $[Co(NH_3)_5OAc]Cl_2$; $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; $[Co(NH_3)_5OAc](NO_3)_2$; and mixtures thereof.

4. A granular detergent composition especially suitable for use in automatic dishwashing machines, which composition comprises by weight:

(a) from about 0.1% to about 10% of the bleach catalyst-containing composite particles according to claim 7;

(b) a bleach component comprising from about 0.01% to about 8% as available oxygen of a peroxygen bleach;

(c) from about 0.1% to about 60% of a pH adjusting component consisting of water-soluble salt or salt/builder mixture selected from sodium carbonate, sodium sesquicarbonate, sodium citrate, citric acid, sodium bicarbonate, sodium hydroxide, and mixtures thereof;

(d) from about 3% to about 10% silicate as $SiO_2$;

(e) from 0 to about 10% of a low-foaming nonionic surfactant other than amine oxide;

(f) from 0 to about 10% of a suds suppressor;

(g) from 0% to about 5% of an active detersive enzyme; and (h) from 0% to about 25% of a dispersant polymer;

wherein said composition provides a wash solution pH from about 9.5 to about 11.5.

5. A granular detergent composition especially suitable for use in automatic dishwashing machines, which composition comprises by weight:

(a) from about 0.1% to about 10% of the bleach catalyst-containing composite particles according to claim 3;

(b) a bleach component comprising from about 0.01% to about 8% as available oxygen of a peroxygen bleach;

(c) from about 0.1% to about 60% of a pH adjusting component consisting of water-soluble salt or salt/builder mixture selected from sodium carbonate, sodium sesquicarbonate, sodium titrate, citric acid, sodium bicarbonate, sodium hydroxide, and mixtures thereof;

(d) from about 3% to about 10% silicate as $SiO_2$;

(e) from 0 to about 10% of a low-foaming nonionic surfactant other than amine oxide;

(f) from 0 to about 10% of a suds suppressor;

(g) from 0% to about 5% of an active detersive enzyme; and (h) from 0% to about 25% of a dispersant polymer;

wherein said composition provides a wash solution pH from about 9.5 to about 11.5.

6. A bleach catalyst-containing composite particle suitable for incorporation into a granular detergent composition, said composite particle comprising:

(a) from about 1% to about 60% of a bleach catalyst having the formula:

$$[Co(NH_3)_n(M)_m(B)_b]T_y$$

wherein cobalt is in the +3 oxidation state; n is 4 or 5; M is one or more ligands coordinated to the cobalt by one site; m is 0, 1 or 2; B is a ligand coordinated to the cobalt by two sites; b is 0 or 1, and when b=0, then m+n=6, and when b=1, then m=0 and n=4; and T is one or more appropriately selected counteranions present in a number y, where y is an integer to obtain a charge-balanced salt; said catalyst having a base hydroylsis rate constant of less than 0.23 $M^{-1}s^{-1}$ (25° C.);

(b) from about 40% to about 99% of polyethylene glycol carrier material that melts within the range of from about 38° C. to about 77° C.;

and wherein further said composite particles have a mean particle size of from about 200 to about 2400 microns and a free water content of less than 6%.

7. The bleach catalyst-containing composite particles according to claim 6 wherein the bleach catalyst is selected from the group consisting of cobalt pentaamine chloride salts, cobalt pentaamine acetate salts, and mixtures thereof.

* * * * *